US006030258A

United States Patent [19]

Fumikura

[11] Patent Number: 6,030,258

[45] Date of Patent: Feb. 29, 2000

[54] ELECTRICAL CONNECTOR

[76] Inventor: Tadahiro Fumikura, 3-13-3, Owada, Ichikawa, Chiba 272, Japan

[21] Appl. No.: 08/942,799

[22] Filed: Oct. 2, 1997

[30] Foreign Application Priority Data

Oct. 9, 1996 [JP] Japan ..... 8-287490

[51] Int. Cl.[7] ..... H01R 13/502

[52] U.S. Cl. ..... 439/686

[58] Field of Search ..... 439/682, 686, 439/607, 405, 67, 77, 407, 866

[56] References Cited

U.S. PATENT DOCUMENTS

| | | | |
|---|---|---|---|
| 4,871,319 | 10/1989 | Babow | 439/77 |
| 4,917,629 | 4/1990 | Matsuzaki et al. | 439/405 |
| 5,129,840 | 7/1992 | Kuzuno et al. | 439/397 |
| 5,199,911 | 4/1993 | Dorwart, Jr. et al. | 439/874 |

FOREIGN PATENT DOCUMENTS

| | | | |
|---|---|---|---|
| 0713268 A2 | 5/1996 | European Pat. Off. | H01R 23/70 |

*Primary Examiner*—Steven L. Stephan
*Assistant Examiner*—Eugene G. Byrd

[57] ABSTRACT

The present invention provides an electrical connector that is relatively compact, and in which there is no danger that wire-connecting sections will be deformed during soldering of conductors thereto. The electrical connector has an insulating housing (30) to which a plurality of contacts (20) are fastened by press-fitting, and a support member (60), that is latchably attached to a cable face (32) of the insulating housing (30). Wire-connecting sections (22) of the contacts (20) protrude in two rows from the cable face (32) of the housing (30); these wire-connecting sections (22) are supported by the support member (60), and are disposed so that access for the purpose of making soldered connections is possible from above and below. The support member (60) has an inter-row partition wall (63) and intra-row partition walls (64) that form insulating-partition walls between the wire-connecting sections (22) of the contacts (20).

8 Claims, 3 Drawing Sheets

ELECTRICAL CONNECTOR

FIELD OF THE INVENTION

The present invention relates to an electrical connector, and more specifically relates to an electrical connector that is equipped with solder cups to which conductors are connected by soldering.

BACKGROUND OF THE INVENTION

One example of an electrical connector is disclosed in U.S. Pat. No. 5,199,911. The disclosed electrical connector has solder cups that are to be electrically connected to contacts that extend from one surface of an insulating housing. These solder cups are disposed so that they face toward the top side and bottom side of the housing, and thus allow access for soldering from two directions, i.e., from the top side and the bottom side. In each soldering cup, a fastening portion that is fastened to the insulating housing and an extending portion that extends from the insulating housing are formed with a substantially cylindrical cross section. Accordingly, the solder cups are firmly supported on the insulating housing, and the solder cups themselves have sufficient mechanical strength, so that there is no danger that the solder cups will be deformed as a result of being pressed by the soldering iron, during the soldering of conductors thereto.

In the electrical connector disclosed above, the dimensions of the solder cups and the insulating housing supporting the solder cups are relatively large. Accordingly, the object of the present invention is to provide an electrical connector that allows easy and reliable soldering of conductors without deforming the solder cups, and that, at the same time, has a relatively compact insulating housing and solder cups.

SUMMARY OF THE PRESENT INVENTION

The present invention provides an electrical connector that has a plurality of contacts, including wire-connecting sections to which electrical conductors are connected by soldering, an insulating housing in which the contacts are affixed, and an insulative support member that is mounted to the insulating housing and that supports the wire-connecting sections of the contacts. The support member has partition walls between the wire-connecting sections while allowing access to the wire-connecting sections from the outside.

Preferably, the plurality of contacts are press-fitted from the rear surface or cable face of the insulating housing on the opposite side of the housing from the front surface or mating face, and the support member is attached to the cable face. In this case, the plurality of contacts are staggered in two rows, and the partition walls comprise an inter-row partition wall and intra-row partition walls that protrude from the inter-row partition wall. Access is possible from either of two directions facing the respective wire-connecting sections.

Furthermore, the support member preferably has a pair of arms that engage with securing sections on the insulating housing in positions on both sides. The connector is preferably constructed so that after the conductors have been connected to the wire-connecting sections, the wire-connecting sections are protected by wrapping a tape around the periphery of the support member. Especially in cases where the partition walls comprise an inter-row partition wall and intra-row partition walls, it is desirable to form additional walls that protrude from the inter-row partition wall so that no unreasonable stress is applied to the wire-connecting sections by the tape.

BRIEF DESCRIPTION OF THE DRAWINGS

The invention will now be described by way of example with reference to the accompanying drawings in which.

DETAILED DESCRIPTION OF THE INVENTION

Figure 1:
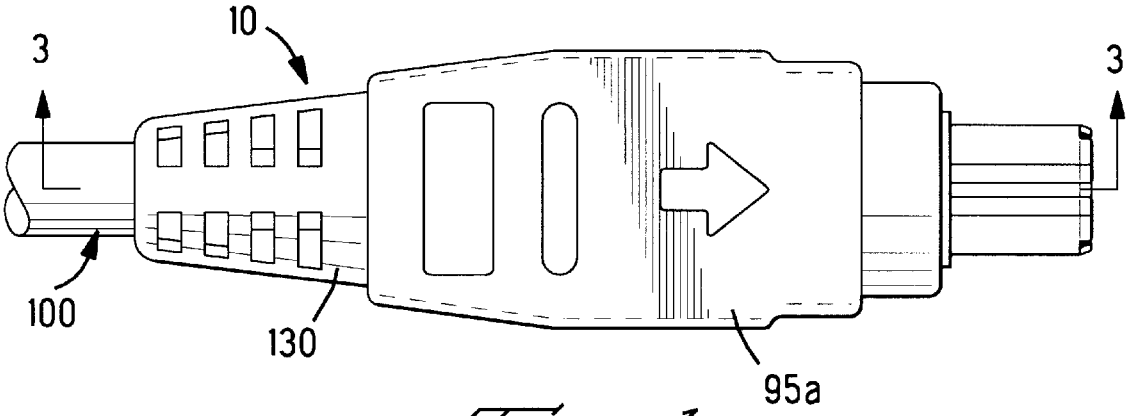
FIGS. 1 and 2 are a top plan and side views of an electrical connector according to the present invention.
Figure 2:
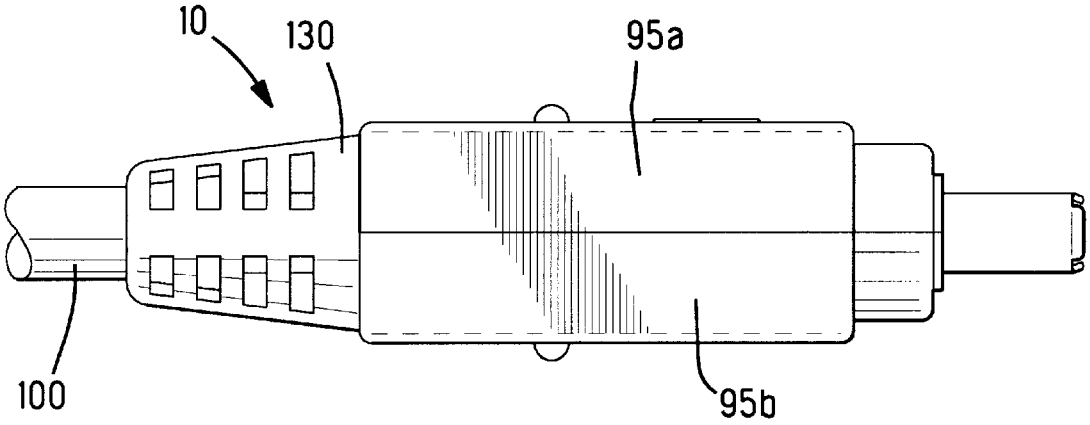
Figure 4:
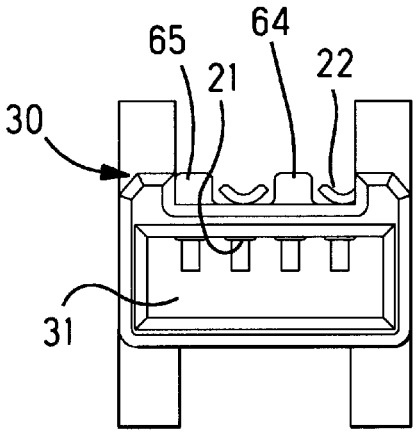
FIG. 4 is a view looking from the right side of FIG. 3 of an assembled contact-carrying housing including an insulating housing, support member and electrical contacts.
Figure 3:
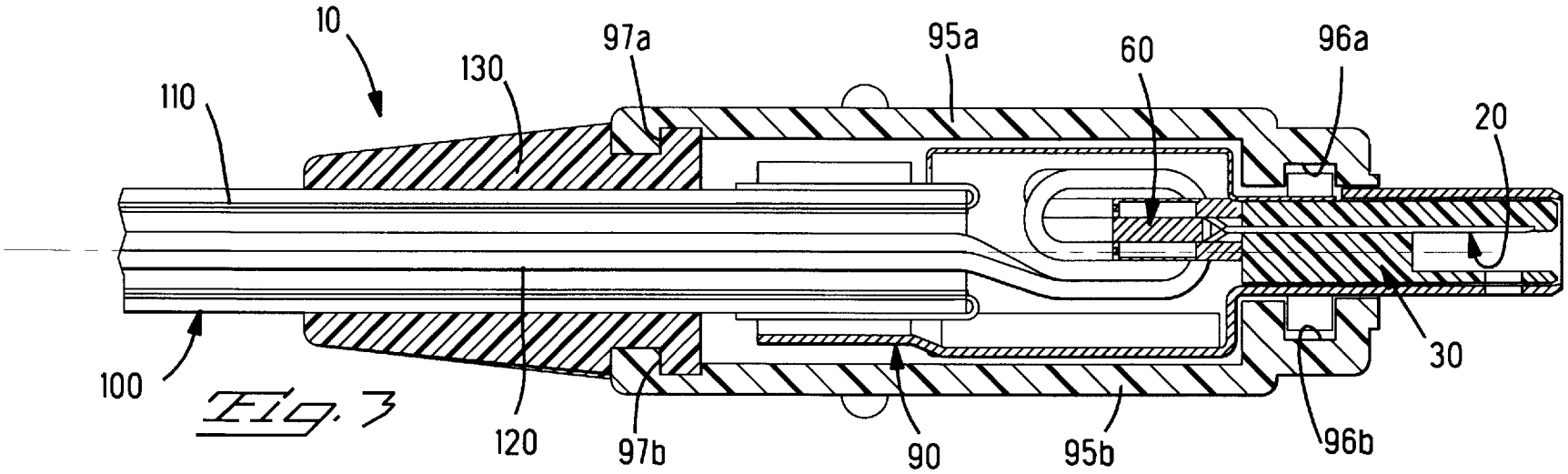
FIG. 3 is a cross-sectional view taken along line 3—3 of FIG. 1.

An electrical connector 10 of the present invention is shown in FIGS. 1 to 3 and terminates a shielded cable 100. Connector 10 has a shielding member 90 that is grounded to the shielding 110 of the cable 100, and a plurality of electrical contacts 20 that are electrically connected with core wires of a plurality of insulated conductors 120 accommodated inside the shielding 110. Cable shielding 110 is folded back at the end of the cable 100, and is connected to the shielding member 90 by a conventional crimping method. Shielding member 90 extends to the mating end where the contacts 20 are disposed, and is constructed so that a ground connection with a shielding member of a mating connector (not shown) takes place. The plurality of contacts 20 are supported by an insulating housing 30 and an insulative support member 60 constituting a contact-carrying member. The respective construction of the contacts 20, insulating housing 30 and support member 60 will be described later. A strain-relief member 130 is attached to the cable 100, and a pair of cover members 95*a* and 95*b* are disposed so that they envelop the end of the cable 100 and solder cups 22 to which the insulated conductors 120 are connected. In this case, cover members 95*a*, 95*b* are engaged with the insulating housing 30 by means of engaging grooves 96*a* and 96*b*, and are engaged with the strain-relief member 130 by means of engaging projections 97*a* and 97*b*.

FIGS. 4 to 8 show the assembled state of the contacts 20, insulating housing 30 and support member 60 used in the electrical connector 10 shown in FIGS. 1 to 3.

Figure 5:
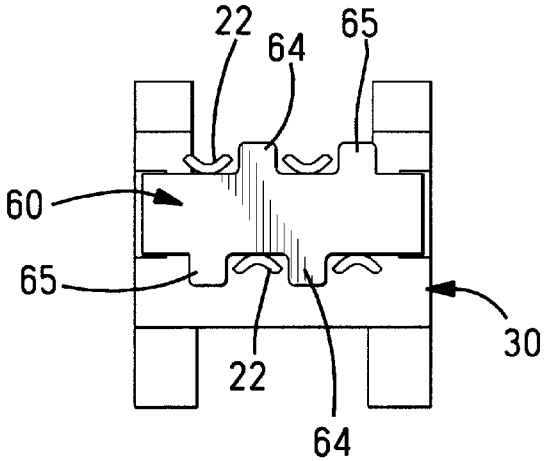
FIG. 5 is a view looking from the left side of FIG. 3 of the assembled contact-carrying housing.
Figure 6:
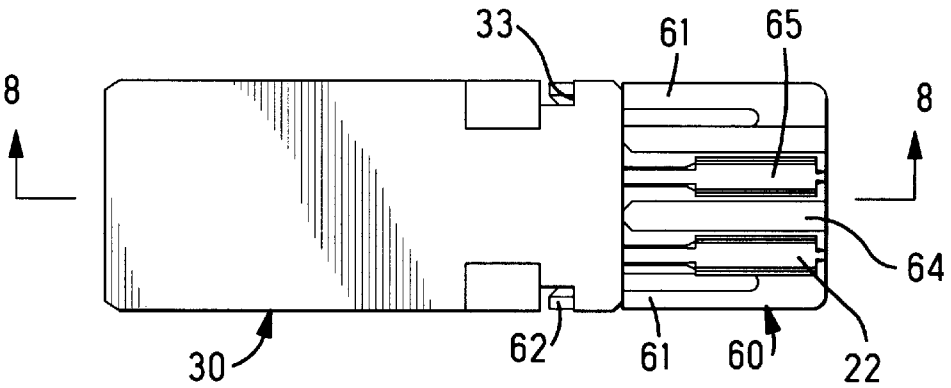
Figure 9:
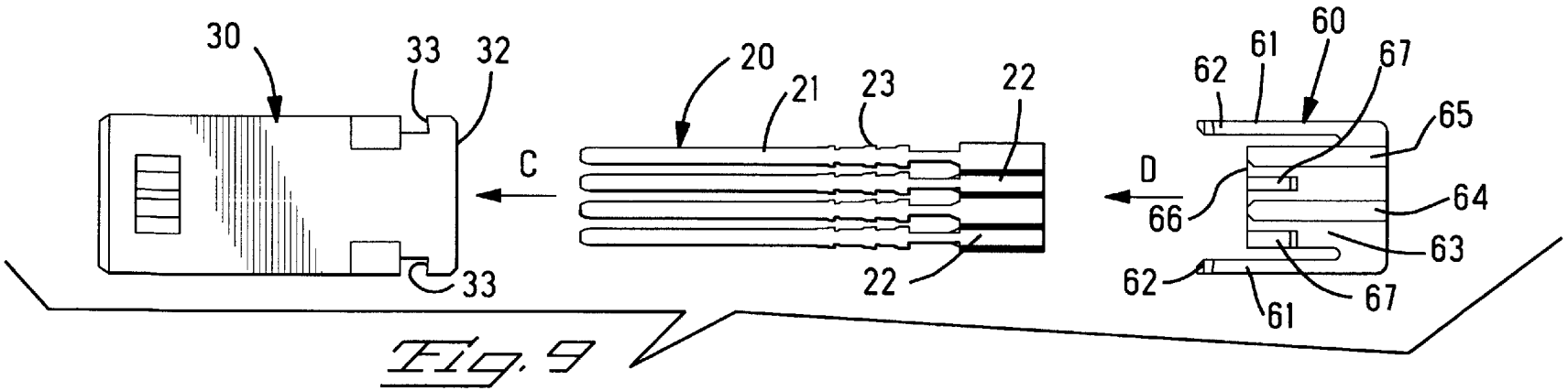
FIG. 9 is a view similar to FIG. 6 showing the insulating housing, electrical contacts and insulative support member prior to being assembled.

As is seen from FIG. 3 and FIG. 6, the insulating housing or contact section-receiving portion 30 accommodates the plurality of contacts 20 that are press-fitted in housing 30 and maintained therein by barbs 23 on the contacts 20. Contact sections 21 engage the contacts of a mating connector and are disposed along an engagement recess 31, and the solder cups or conductor-connecting sections 22 of the respective contacts 20 are caused to extend from cable face 32 of housing 30. In FIG. 9, the direction of press-fitting of the contacts 20 is indicated by arrow C. It can be seen that the plurality of contacts 20 are press-fitted from the cable face 32 of the insulating housing 30. Solder cups 22 of the contacts 20 are alternately offset upward and downward so that the solder cups 22 are disposed in two rows so that they are disposed in a staggered arrangement that allows access from above or below as shown in FIG. 5.

Figure 7:
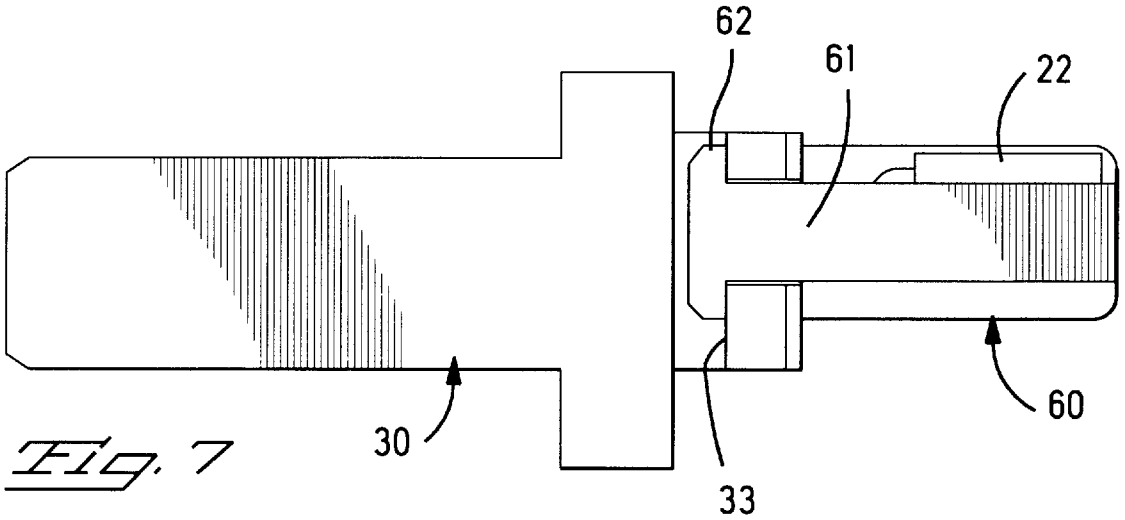
FIGS. 6 and 7 are a top plan and side views of the assembled contact-carrying housing.
Figure 8:
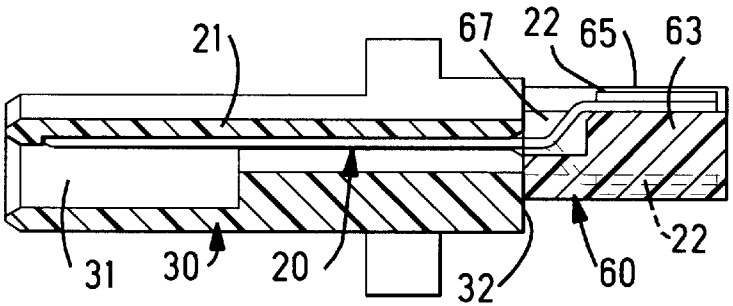
FIG. 8 is a cross-sectional view taken along line 8—8 of FIG. 6.

As shown in FIGS. 6 to 8, and in FIG. 3, a support member or conductor-connecting-supporting portion 60, that supports the solder cups 22 is latchably attached to the cable face 32 of the insulating housing 30, with the direction of attachment being indicated by arrow D in FIG. 9. The support member 60 has cantilever-engaging arms 61 on both sides, substantially T-shaped engaging pawls 62 are formed on the ends of the engaging arms 61; substantially T-shaped engaging grooves 33 are formed in both side surfaces of the insulating housing 30 near the rear end of the insulating housing 30. Support member 60 is latchably fastened to the insulating housing 30 by engagement of the engaging pawls 62 with the engaging grooves 33. When support member 60 is in the latched position, its attachment surface 66 (see FIG. 9) substantially engages the cable face 32 of the insulating housing 30.

As is clear from FIGS. 4 to 7, support member 60 has a relatively thick inter-row partition wall 63 and intra-row partition walls 64 that are formed so that intra-row partition walls 64 protrude from the inter-row partition wall 63 in positions thereby providing areas for receiving and locating the solder cups 22 so that they are aligned in rows. When the support member 60 is latched to the insulating housing 30, the inter-row partition wall 63 is disposed so that the back surfaces of the solder cups 22 substantially engage wall 63. When the insulated conductors 120 have been stripped to expose the core wires, and the core wires are soldered to the solder cups 22, the inter-row partition wall 63 supports the solder cups 22 so that there is no danger of deformation of the solder cups 22. As is shown in FIG. 9, the support member 60 includes slots 67 that support portions of the contacts 20 in positions corresponding to the solder cups 22 near the attachment surface. Furthermore, the inter-row partition wall 63 and the intra-row partition walls 64 are positioned between the solder cups 22 of the contacts 20. Accordingly, the inter-row partition wall 63 and intra-row partition walls 64 act as insulating partition walls between the solder cups 22 so that short-circuiting between the contacts 20 is prevented. Support member 60 also has additional walls 65 that have substantially the same shape and dimensions as the intra-layer partition walls 64. An insulating tape (not shown) is used to protect the soldered portions following the soldering of the insulated conductors 20 and is wrapped around the periphery of the support member 60. The additional walls 65 act in conjunction with the intra-row partition walls 64 to prevent any undesirable stress from being applied to the solder cups 22 during the wrapping of the insulating tape.

An electrical connector of the present invention has been described above; however, it is merely an example. Therefore, various modifications and alterations may be made to the electrical connector by persons skilled in the art.

In the electrical connector of the present invention, electrical contacts, that are fastened to an insulating housing by press-fitting, are supported by a support member that is latchably mounted on an insulating housing; furthermore, the support member has partition walls between wire-connecting sections of the electrical contacts. Accordingly, a construction is realized in which the insulating housing and contacts are relatively compact, and in which there is no danger that the wire-connecting sections will be deformed during soldering. In this construction, furthermore, the operating conditions of the soldering operation are good, and short circuiting between the wire-connecting sections can be reliably prevented.

What is claimed is:

1. An electrical connector comprising a contact-carrying member including a contact section-receiving portion separate from a conductor-connecting-supporting portion;

latching members provided by said contact section-receiving portion to latch said contact section-receiving portion and said conductor-connecting-supporting portion together;

electrical contacts having contact sections extending along said contact section-receiving portion and conductor-connection sections disposed along said conductor-connection-supporting portion; and partition walls on said conductor-connecting-supporting portion between which the conductor-connecting sections are disposed thereby permitting access to said conductor-connecting sections to connect electrical conductors thereto.

2. An electrical connector as claimed in claim 1, wherein said conductor-connecting sections have a U-shape configuration.

3. An electrical connector as claimed in claim 2, wherein said conductor-connecting sections are alternately offset upward and downward so that the conductor-connection sections are disposed in two rows along said conductor-connecting-supporting portion.

4. An electrical connector as claimed in claim 3, wherein the conductor-connecting sections are staggered.

5. An electrical connector comprising a contact-carrying member including a contact section-receiving portion and a conductor-connecting-supporting portion;

electrical contacts having contact sections extending along said contact section-receiving portion and conductor-connection sections alternatively offset upward and downward so that the conductor-connection sections are disposed in two rows along said conductor-connecting-supporting portion; and partition walls on said conductor-connecting-supporting portion between which the conductor-connecting sections are disposed thereby permitting access to said conductor-connecting sections to connect electrical conductors thereto.

6. An electrical connector as claimed in claim 5, wherein said contact section-receiving portion and said conductor-connecting-supporting portion are separate, and latching members provided by said contact section-receiving portion and said conductor-connecting-supporting portion to latch said contact section-receiving portion and said conductor-connecting-supporting portion together.

7. An electrical connector as claimed in claim 5, wherein said conductor-connecting sections have a U-shape configuration.

8. An electrical connector as claimed in claim 5, wherein the conductor-connecting sections are staggered.

* * * * *